US008766120B2

(12) United States Patent
Suo

(10) Patent No.: US 8,766,120 B2
(45) Date of Patent: Jul. 1, 2014

(54) MICROSWITCH

(75) Inventor: Kai Suo, Nagano (JP)

(73) Assignee: Nidec Sankyo Corporation (JP)

( * ) Notice: Subject to any disclaimer, the term of this patent is extended or adjusted under 35 U.S.C. 154(b) by 131 days.

(21) Appl. No.: 13/497,931

(22) PCT Filed: Sep. 13, 2010

(86) PCT No.: PCT/JP2010/065694

§ 371 (c)(1),
(2), (4) Date: Mar. 23, 2012

(87) PCT Pub. No.: WO2011/037029

PCT Pub. Date: Mar. 31, 2011

(65) Prior Publication Data

US 2013/0126321 A1 May 23, 2013

(30) Foreign Application Priority Data

Sep. 25, 2009 (JP) ..... 2009-221094

(51) Int. Cl.
*H01H 3/04* (2006.01)

(52) U.S. Cl.
USPC ..... 200/335; 200/459; 200/332

(58) Field of Classification Search
USPC ..... 200/453, 459, 445, 467
See application file for complete search history.

(56) References Cited

U.S. PATENT DOCUMENTS 2,898,428 A * 8/1959 Holden ..... 200/332
3,774,000 A * 11/1973 Beer ..... 200/332
4,874,912 A * 10/1989 Kakuta et al. ..... 200/16 D
4,902,863 A * 2/1990 Fukuma ..... 200/445
5,565,666 A * 10/1996 Kautz ..... 200/83 P
5,663,540 A * 9/1997 Inpyn ..... 200/17 R

FOREIGN PATENT DOCUMENTS

JP 54-166590 U 11/1979
JP 56-100833 U 8/1981
JP 56-107639 U 8/1981
JP 9-161609 A 6/1997
JP 2003-86401 A 3/2003

OTHER PUBLICATIONS

International Search Report for International Application No. PCT/JP2010/065694, dated Oct. 19, 2010, with English translation.

* cited by examiner

*Primary Examiner* — Kyung Lee
(74) *Attorney, Agent, or Firm* — Cantor Colburn LLP

(57) ABSTRACT

Provided is a microswitch wherein the versatility of a lever member can be prevented from being reduced while the rigidity of the lever member is improved. The microswitch is provided with a housing containing a switch mechanism, a plunger which transmits power to the switch mechanism, and a lever member, the base end of which is supported by the housing. In the microswitch, the tip end of the plunger abuts with the bottom surface of the lever member at an intermediate position in the longitudinal direction of the lever member, and an object to be detected can abut with the top surface of the lever member on the tip end side of the lever member. Further, a first reinforcement portion is formed on the top surface of the lever member, excluding an object abutment portion with which the object to be detected is to be abutted, and a second reinforcement portion is formed on the bottom surface of the lever member, excluding a plunger abutment portion.

11 Claims, 4 Drawing Sheets

MICROSWITCH

CROSS REFERENCE TO RELATED APPLICATIONS

This is a U.S. national stage of application No. PCT/JP2010/065694, filed on Sep. 13, 2010. Priority under 35 U.S.C. §119(a) and 35 U.S.C. §365(b) is claimed from Japanese Application No. 2009-221094, filed Sep. 25, 2009, the disclosure of which is also incorporated herein by reference.

TECHNICAL FIELD

The present invention relates to a microswitch for detecting a predetermined object to be detected.

BACKGROUND

Conventionally, for example, a microswitch 101 shown in FIG. 5 has been known as a microswitch for detecting a predetermined object to be detected. The microswitch 101 includes a housing 107 in which fixed side contact points 102 and 103, a movable side contact point 104 and plate springs 105 and 106 are incorporated, a plunger 108 for transmitting power to the plate spring 105, and a lever member 109 whose one end is supported by the housing 107. The lever member 109 is a plate spring which is formed by bending a metal flat plate-shaped member in a substantially "L"-shape as shown in FIG. 6.

In the microswitch 101, an object to be detected (not shown) is abutted with an upper face on the right end side of the lever member 109 in FIG. 5 and, when the lever member 109 is turned in a clockwise direction in FIG. 5 with its one end side as a supporting point, the lever member 109 presses the plunger 108 downward. When the plunger 108 is depressed, the plate springs 105 and 106 are deformed and the movable side contact point 104 having been contacted with the fixed side contact point 102 is separated from the fixed side contact point 102 to be contacted with the fixed side contact point 103. Further, when the movable side contact point 104 is contacted with the fixed side contact point 103, the object to be detected is detected by the microswitch 101.

Further, conventionally, a microswitch has been also known which is provided with a lever member having high rigidity that is formed with a reinforcing means against bending of the lever member (see, for example, Patent Literature 1). In the microswitch described in Patent Literature 1, a reinforcing flange or a reinforcement rib as the reinforcing means is formed in the lever member along a longitudinal direction of the lever member. Alternatively, in the microswitch, a reinforcing beam as the reinforcing means is formed in the lever member along the longitudinal direction of the lever member. Specifically, the reinforcing means is formed in a face of the lever member opposite to a face where the plunger is abutted. Further, in the microswitch, a roller with which an object to be detected is abutted is attached on a tip end side of the lever member.

[PTL 1] Japanese Patent Laid-Open No. Hei 9-161609

As described above, in the microswitch described in Patent Literature 1, since the reinforcing means is formed in the lever member, rigidity of the lever member is increased and a malfunction of the microswitch can be prevented. Similarly, when a reinforcing means is formed in the lever member 109 shown in FIG. 6, rigidity of the lever member 109 is increased and a malfunction of the microswitch 101 can be prevented.

However, in the microswitch 101, an object to be detected is directly abutted with the face of the lever member 109 (upper face in FIG. 5) opposite to the face where the plunger 108 is abutted. Therefore, a reinforcing means formed in the lever member described in Patent Literature 1 is formed on the lever member 109 as it is, an object to be detected may be abutted with the reinforcing means in the microswitch 101. Therefore, in the microswitch 101, a relative distance between the microswitch 101 and an object to be detected when the object is detected by the microswitch 101 may be varied depending on whether the reinforcing means is formed in the lever member 109 or not. Accordingly, in a case that a reinforcing means described in Patent Literature 1 is formed in the lever member 109 as it is, change of arrangement position or the like of the microswitch 101 is required. Further, when the reinforcing means described in Patent Literature 1 is formed in the lever member 109 as it is, in the microswitch 101, an outside dimension of the microswitch 101 becomes large. As described above, when the reinforcing means described in Patent Literature 1 is formed in the lever member 109 of the microswitch 101 as it is, the versatility of the microswitch 101 may be lowered.

SUMMARY

In view of the problem described above, at least an embodiment of the present invention provides a microswitch which is capable of preventing its versatility from being lowered while increasing the rigidity of the lever member.

In order to attain the objective, at least an embodiment of the present invention provides a microswitch including a housing into which a switch mechanism is incorporated, a plunger which is movably held by the housing for transmitting power to the switch mechanism, and a lever member in a plate spring shape whose base end side is supported by the housing and which is tunable with the base end side as a supporting point. A tip end of the plunger is abutted with one face of the lever member in a turning direction of the lever member at an intermediate position in a longitudinal direction of the lever member, and an object to be detected is capable of abutting with the other face of the lever member in the turning direction of the lever member on a tip end side of the lever member. In this structure, when a portion of the lever member where the tip end of the plunger is abutted is a plunger abutting part and a portion of the lever member where the object to be detected is capable of abutting is an object abutting part, a first reinforcing part for reinforcing strength of the lever member is formed at a position avoiding the object abutting part in the other face of the lever member, and a second reinforcing part for reinforcing strength of the lever member is formed at a position avoiding the plunger abutting part in the one face of the lever member.

In the microswitch in at least an embodiment of the present invention, a first reinforcing part and a second reinforcing part for reinforcing the strength of the lever member are formed in the lever member. Therefore, in at least an embodiment of the present invention, the rigidity of the lever member is increased.

Further, in at least an embodiment of the present invention, a tip end of the plunger is abutted with one face of the lever member in the turning direction of the lever member and an object to be detected is capable of abutting with the other face of the lever member in the turning direction of the lever member. Further, a first reinforcing part is formed at a position avoiding the object abutting part in the other face of the lever member and a second reinforcing part for reinforcing strength of the lever member is formed at a position avoiding the plunger abutting part in the one face of the lever member. Therefore, contacting of the first reinforcing part and the second reinforcing part with the tip end of the plunger is prevented and contacting of the first reinforcing part and the second reinforcing part with an object to be detected is prevented. Accordingly, even when the first reinforcing part and the second reinforcing part are formed in the lever member, a relative distance between the microswitch and an object to be detected when the object is detected is hard to be varied in the microswitch. Further, the second reinforcing part is formed on one face of the lever member with which the tip end of the plunger is abutted and the first reinforcing part is formed at a position avoiding the object abutting part on the tip end side of the lever member. Therefore, even when the first reinforcing part and the second reinforcing part are formed in the lever member, the outside dimension of the microswitch is hard to be changed. Therefore, for example, the microswitch in at least an embodiment of the present invention can be provided with compatibility with the conventional microswitch 101. As a result, in at least an embodiment of the present invention, the versatility of the microswitch can be prevented from being lowered.

In at least an embodiment of the present invention, for example, the first reinforcing part is formed from the base end side of the lever member toward the plunger abutting part, and the second reinforcing part is formed from the tip end side of the lever member toward the plunger abutting part. In this case, it is preferable that the first reinforcing part and the second reinforcing part are continuously formed in the longitudinal direction of the lever member. In other words, it is preferable that the first reinforcing part and the second reinforcing part are continuously formed in the longitudinal direction of the lever member instead of being formed in a divided manner. According to this structure, the rigidity of the lever member is further increased.

In at least an embodiment of the present invention, it is preferable that a tip end side end of the first reinforcing part in the longitudinal direction of the lever member is disposed on the tip end side of the lever member with respect to the plunger abutting part, and a base end side end of the second reinforcing part in the longitudinal direction of the lever member is disposed on the tip end side of the lever member with respect to the plunger abutting part. According to this structure, contacting of the second reinforcing part with the tip end of the plunger is prevented surely.

In at least an embodiment of the present invention, it is preferable that a tip end side end of the first reinforcing part in the longitudinal direction of the lever member and a base end side end of the second reinforcing part in the longitudinal direction of the lever member are substantially coincided with each other in the longitudinal direction of the lever member. Further, in at least an embodiment of the present invention, it is further preferable that a tip end side end portion of the first reinforcing part in the longitudinal direction of the lever member and a base end side end portion of the second reinforcing part in the longitudinal direction of the lever member are overlapped with each other in the longitudinal direction of the lever member. According to this structure, the rigidity of the lever member is further increased.

In at least an embodiment of the present invention, the first reinforcing part and the second reinforcing part is, for example, a reinforcing flange which is formed by bending an end part of the lever member in a direction perpendicular to the longitudinal direction of the lever member or a reinforcing rib which is formed along the longitudinal direction of the lever member.

In at least an embodiment of the present invention, it is preferable that the housing is formed of thermoplastic resin. According to this structure, for example, when the microswitch is to be discarded, the resin structuring the housing can be reused. Therefore, environmental load can be reduced. Further, in this case, it is preferable that the housing is formed of liquid crystalline thermoplastic resin. According to this structure, even when the housing is formed of thermoplastic resin, the heat resisting property of the housing can be enhanced.

As described above, in the microswitch of at least an embodiment of the present invention, its versatility can be prevented from being lowered while increasing the rigidity of the lever member.

BRIEF DESCRIPTION OF DRAWINGS

Embodiments will now be described, by way of example only, with reference to the accompanying drawings which are meant to be exemplary, not limiting, and wherein like elements are numbered alike in several Figures, in which:

FIG. 1(A) is a view showing the microswitch in an "OFF" state and FIG. 1(B) is a view showing the microswitch in an "ON" state.

DETAILED DESCRIPTION

Embodiments of the present invention will be described below with reference to the accompanying drawings.

(Structure of Microswitch)

Figure 1A:
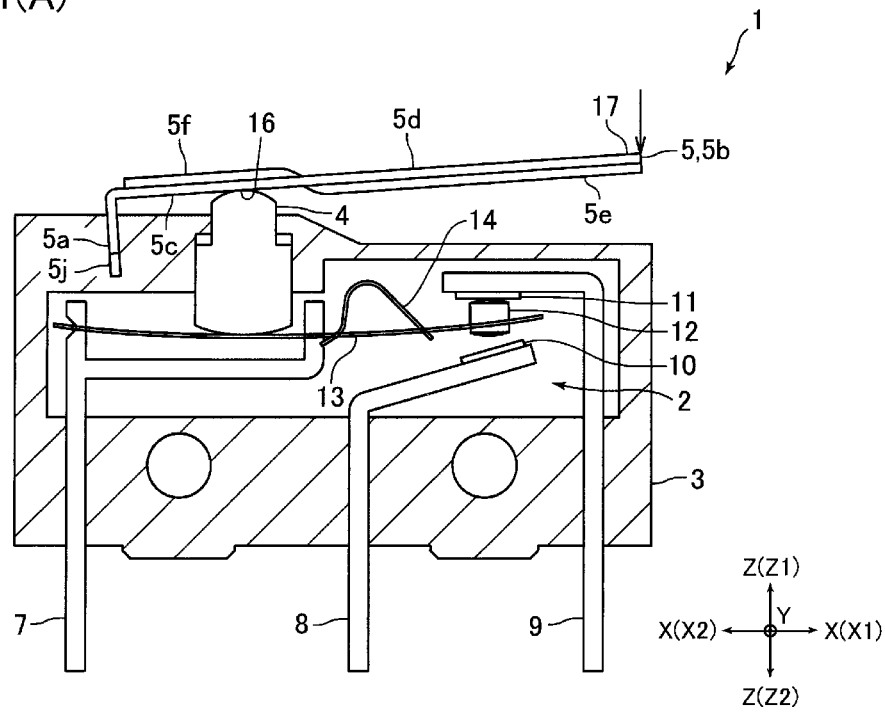
FIGS. 1(A) and 1(B) are cross-sectional views showing a microswitch in accordance with an embodiment of the present invention.
Figure 1B:
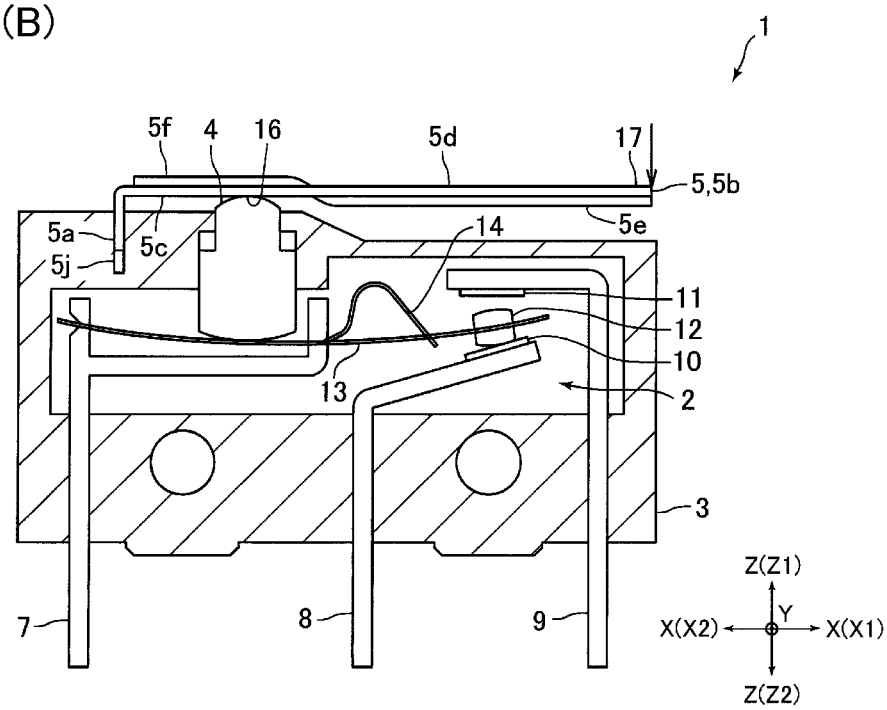
Figure 2:
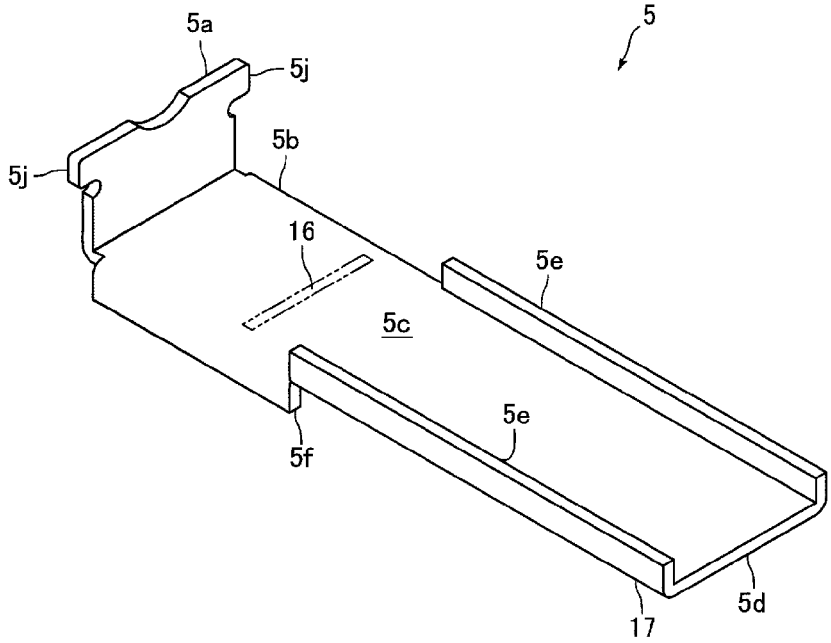
FIG. 2 is a perspective view showing a lever member shown in FIGS. 1(A) and 1(B).

FIGS. 1(A) and 1(B) are cross-sectional views showing a microswitch 1 in accordance with an embodiment of the present invention. FIG. 1(A) is a view showing the microswitch 1 in an "OFF" state and FIG. 1(B) is a view showing the microswitch 1 in an "ON" state. FIG. 2 is a perspective view showing a lever member 5 shown in FIGS. 1(A) and 1(B).

The microswitch 1 in this embodiment is a detection device for detecting a predetermined object to be detected (not shown). The microswitch 1 includes a switch mechanism 2, a housing 3 into which the switch mechanism 2 is incorporated, a plunger 4 which is movably held by the housing 3 for transmitting power to the switch mechanism 2, and a lever member 5 whose base end is supported by the housing 3. In the following descriptions, three directions perpendicular to each other are set to be an "X" direction, a "Y" direction and a "Z" direction. Further, the "X" direction is set to be a "right and left direction", the "Y" direction is set to be a "front and rear direction" and the "Z" direction is set to be an "upper and lower direction". Further, an "X1" direction side is a "right" side, an "X2" direction side is a "left" side, a "Z1" direction side is an "upper" side, and a "Z2" direction side is a "lower" side.

The switch mechanism 2, which is a so-called snap action mechanism, includes three terminals, i.e., a first terminal 7, a second terminal 8 and a third terminal 9, a fixed side contact point 10 fixed to the second terminal 8, a fixed side contact point 11 fixed to the third terminal 9, a movable side contact point 12, a contact point spring 13 holding the movable side contact point 12, and a curved spring 14 which urges the contact point spring 13. The contact point spring 13 and the curved spring 14 are a metal plate spring.

The upper end sides of the first terminal 7, the second terminal 8 and the third terminal 9 are disposed in the inside of the housing 3 and the lower end sides of the first terminal 7, the second terminal 8 and the third terminal 9 are protruded to the outer side of the housing 3. A base end (left end) of the contact point spring 13 is held by an upper end side of the first terminal 7 and a tip end (right end) of the contact point spring 13 holds the movable side contact point 12. The fixed side contact point 10 and the fixed side contact point 11 are disposed so as to face each other in the upper and lower direction and the movable side contact point 12 is disposed between the fixed side contact point 10 and the fixed side contact point 11.

The housing 3 is formed of thermoplastic resin. Specifically, the housing 3 is formed of liquid crystalline thermoplastic resin such as liquid crystal polymer (LCP). The plunger 4 is held by the housing 3 so as to be capable of moving in the upper and lower direction. The base end (lower end) of the plunger 4 is abutted with the contact point spring 13. Further, the tip end (upper end) of the plunger 4 is abutted with the lever member 5. In this embodiment, as shown in FIGS. 1(A) and 1(B), the base end and the tip end of the plunger 4 are formed in a substantially circular arc shape when viewed in the front and rear direction.

The lever member 5 is, as shown in FIG. 2, a plate spring which is formed by bending a metal plate-shaped member formed in a substantially rectangular plate shape in a roughly "L"-shape. The lever member 5 is provided with a short side part 5*a* structuring the base end side of the lever member 5 and a long side part 5*b* which is substantially perpendicular to the short side part 5*a* and is longer than the short side part 5*a*. A lower end (upper end in FIG. 2) of the short side part 5*a* is formed with protruded parts 5*j* which are protruded to both sides in the front and rear direction. As described above, the base end side of the lever member 5 is supported by the housing 3. In other words, the short side part 5*a* is supported by the housing 3. Further, the lever member 5 is turnable with the protruded parts 5*j* of the short side part 5*a* as a supporting point. Specifically, the long side part 5*b* is tunable with the protruded parts 5*j* of the short side part 5*a* as a supporting point.

As described above, the tip end of the plunger 4 is abutted with the lever member 5. Specifically, the tip end of the plunger 4 is abutted with an under face 5*c* of the long side part 5*b* at an intermediate position in a longitudinal direction of the long side part 5*b* (more specifically, at a position nearer to the short side part 5*a* than the center in the longitudinal direction of the long side part 5*b*). Further, in this embodiment, an object to be detected is capable of abutting with the tip end side (right end side) of the long side part 5*b*. Specifically, an object to be detected is capable of abutting with an upper face 5*d* on the tip end side of the long side part 5*b*. In this embodiment, a portion of the lever member 5 with which the tip end of the plunger 4 is abutted is a plunger abutting part 16 and a portion of the lever member 5 with which an object to be detected is abutted is an object abutting part 17.

As described above, the tip end of the plunger 4 is formed in a substantially circular arc shape when viewed in front and rear direction and is brought into line contact with the lever member 5. Further, as described above, the lever member 5 is tunable with the protruded parts 5*j* of the short side part 5*a* as a supporting point and thus, when the lever member 5 is turned with the protruded parts 5*j* of the short side part 5*a* as a supporting point, a portion of the lever member 5 which is line-contacted with the tip end of the plunger 4 is displaced in the longitudinal direction of the long side part 5*b*. Therefore, in this embodiment, a region which is surrounded by the two-dot chain line in FIG. 2 is a plunger abutting part 16.

As shown in FIG. 2, the under face 5*c* of the long side part 5*b* is formed with reinforcing flanges 5*e* for reinforcing the strength of the long side part 5*b* so as to protrude to the lower side (upper side in FIG. 2). Further, the upper face 5*d* of the long side part 5*b* is formed with reinforcing flanges 5*f* for reinforcing the strength of the long side part 5*b* so as to protrude to the upper side (lower side in FIG. 2).

Specifically, the reinforcing flanges 5*f* are formed at positions avoiding the object abutting part 17 and the reinforcing flanges 5*e* are formed at positions avoiding the plunger abutting part 16. More specifically, as shown in FIGS. 1(A) and 1(B), the reinforcing flange 5*f* is continuously formed in the longitudinal direction of the long side part 5*b* from the base end (left end) of the long side part 5*b* in the longitudinal direction of the long side part 5*b* to a slightly right side with respect to the plunger abutting part 16 without being formed with a cut-out part. Further, the reinforcing flange 5*e* is continuously formed in the longitudinal direction of the long side part 5*b* from the slightly right side with respect to the plunger abutting part 16 in the longitudinal direction of the long side part 5*b* to the tip end of the long side part 5*b* without being formed with a cut-out part. In other words, the reinforcing flange 5*f* is formed from the base end side of the lever member 5 toward the plunger abutting part 16 and the reinforcing flange 5*e* is formed from the tip end side of the lever member 5 toward the plunger abutting part 16. Further, the right end of the reinforcing flange 5*f* is disposed on the right side with respect to the plunger abutting part 16 and the left end of the reinforcing flange 5*e* is disposed on the right side with respect to the plunger abutting part 16.

In this embodiment, the reinforcing flanges 5*e* and 5*f* are formed so that the right end of the reinforcing flange 5*f* and the left end of the reinforcing flange 5*e* are substantially coincided with each other in the longitudinal direction of the long side part 5*b*. Further, the reinforcing flanges 5*e* and 5*f* are formed by bending both end parts of the long side part 5*b* in the front and rear direction to a substantially right angle. The reinforcing flange 5*f* in this embodiment is a first reinforcing part for reinforcing the strength of the lever member 5 and the reinforcing flange 5*e* is a second reinforcing part for reinforcing the strength of the lever member 5.

In the microswitch 1 structured as described above, when an object to be detected is not abutted with the tip end side of the lever member 5, as shown in FIG. 1(A), the fixed side contact point 11 and the movable side contact point 12 are contacted with each other. This state is an "OFF" state of the microswitch 1. On the other hand, when an object to be detected is abutted with the tip end side of the lever member 5, as shown in FIG. 1(B), the lever member 5 is turned with its base end side as a supporting point to depress the plunger 4. When the plunger 4 is depressed, the contact point spring 13 and the curved spring 14 are deformed and the movable side contact point 12 is separated from the fixed side contact point 11 to contact with the fixed side contact point 10. When the fixed side contact point 10 and the movable side contact point 12 are contacted with each other, the micro switch 1 is turned to an "ON" state.

(Principal Effects in this Embodiment)

As described above, in this embodiment, the reinforcing flanges 5*e* and 5*f* are formed in the lever member 5. Therefore, the rigidity of the lever member 5 is increased. Especially, in this embodiment, the reinforcing flanges 5*e* and 5*f* are formed so that the right end of the reinforcing flange 5*f* and the left end of the reinforcing flange 5*e* are substantially coincided with each other in the longitudinal direction of the long side part 5*b*. Therefore, the rigidity of the lever member 5 is effectively increased in comparison with a case that a space is formed between the right end of the reinforcing flange 5*f* and the left end of the reinforcing flange 5*e* in the longitudinal direction of the long side part 5*b*. Further, in this embodiment, the reinforcing flanges 5*e* and 5*f* are continuously formed in the longitudinal direction of the long side part 5*b* without a cut-out part in its intermediate portion. Therefore, the rigidity of the lever member 5 is effectively increased in comparison with a case that each of the reinforcing flanges 5*e* and 5*f* is formed in a divided manner in the longitudinal direction of the long side part 5*b*.

Figure 3:
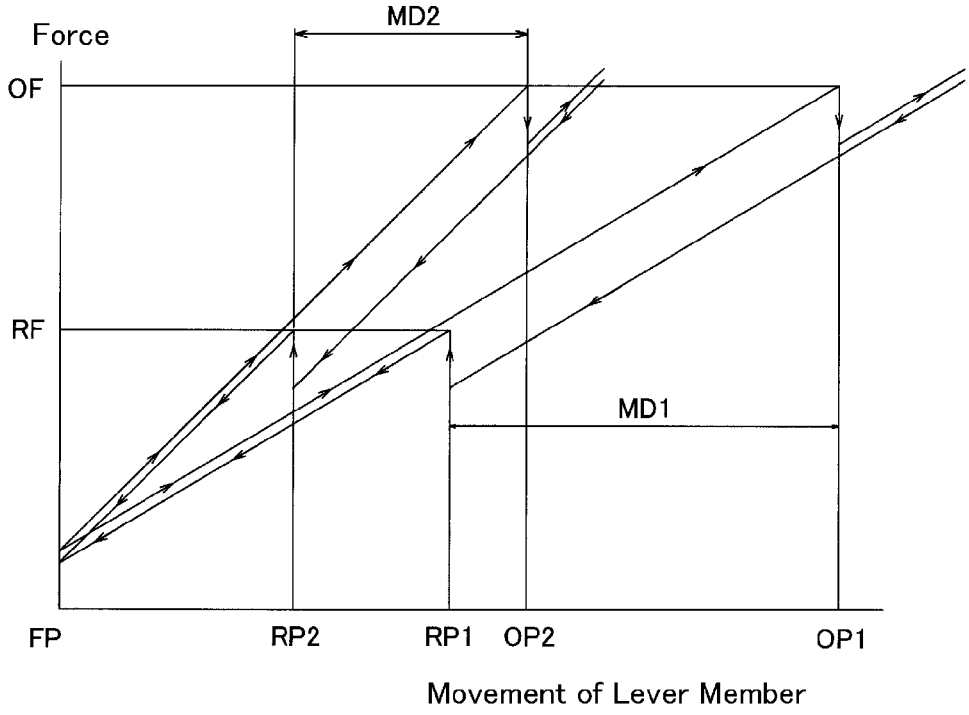
FIG. 3 is a graph for explaining a difference between a sensitivity difference of a microswitch in accordance with an embodiment of the present invention and a sensitivity difference of a conventional microswitch.

Accordingly, in this embodiment, the sensitivity difference (hysteresis) of the microswitch 1 can be made small, for example, in comparison with the conventional microswitch 101. In other words, as shown in FIG. 3, the sensitivity difference "MD2" of the microswitch 1 is made smaller than the sensitivity difference "MD1" of the conventional microswitch 101. Therefore, in this embodiment, the detection accuracy of the microswitch 1 can be enhanced in comparison with the conventional microswitch 101.

In FIG. 3, the "FP" represents the positions of the plungers 4 and 108 when an object to be detected is not abutted with the lever members 5 and 109. Further, the "OP1" represents the position of the plunger 108 when the micro switch 101 is turned to "on" from "off" as an external force acting on the lever member 109 is increased. Further, the "RP1" represents the position of the plunger 108 when the micro switch 101 is turned to "off" from "on" as the external force acting on the lever member 109 is decreased. Further, the "OP2" represents the position of the plunger 4 when the micro switch 1 is turned to "on" from "off" as an external force acting on the lever member 5 is increased. Further, the "RP2" represents the position of the plunger 4 when the micro switch 1 is turned to "off" from "on" as the external force acting on the lever member 5 is decreased. Further, the "OF" represents a force acting on the plungers 4 and 108 at the positions "OP1" and "OP2" and the "RF" represents a force acting on the plungers 4 and 108 at the positions "RP1" and "RP2".

In this embodiment, the reinforcing flange 5*f* is formed from the base end of the long side part 5*b* in the longitudinal direction of the long side part 5*b* to a slightly right side with respect to the plunger abutting part 16 and the reinforcing flange 5*e* is formed from a slightly right side with respect to the plunger abutting part 16 in the longitudinal direction of the long side part 5*b* to the tip end of the long side part 5*b*. Further, the reinforcing flange 5*f* is formed on the upper face 5*d* side of the long side part 5*b* with which an object to be detected is abutted and the reinforcing flange 5*e* is formed on the under face 5*c* side of the long side part 5*b* with which the tip end of the plunger 4 is abutted. Therefore, the reinforcing flanges 5*e* and 5*f* and the tip end of the plunger 4 are not abutted with each other and the reinforcing flanges 5*e* and 5*f* and an object to be detected are not abutted with each other. Accordingly, even when the reinforcing flanges 5*e* and 5*f* are formed in the lever member 5, a relative distance between the microswitch 1 and an object to be detected is hard to be varied when the object to be detected is detected by the microswitch 1. Further, the reinforcing flange 5*e* is formed on the tip end side of the lever member 5 on the under face 5*c* side of the lever member 5 and thus, even when the reinforcing flange 5*e* is formed in the lever member 5, the outside dimension of the microswitch 1 is hard to be changed. Therefore, for example, the microswitch 1 in this embodiment can be provided with compatibility with the conventional micro switch 101. As a result, in this embodiment, the versatility of the microswitch 1 can be prevented from being lowered.

In this embodiment, the housing 3 is formed of thermoplastic resin. Therefore, for example, when the microswitch 1 is to be discarded, the resin structuring the housing 3 can be reused. Accordingly, in this embodiment, environmental load can be reduced. Further, in this embodiment, the housing 3 is formed of liquid crystalline thermoplastic resin and thus, even when the housing 3 is formed of thermoplastic resin, the heat resisting property of the housing 3 can be enhanced.

Other Embodiments

Although the present invention has been shown and described with reference to a specific embodiment, various changes and modifications will be apparent to those skilled in the art from the teachings herein.

Figure 4A:
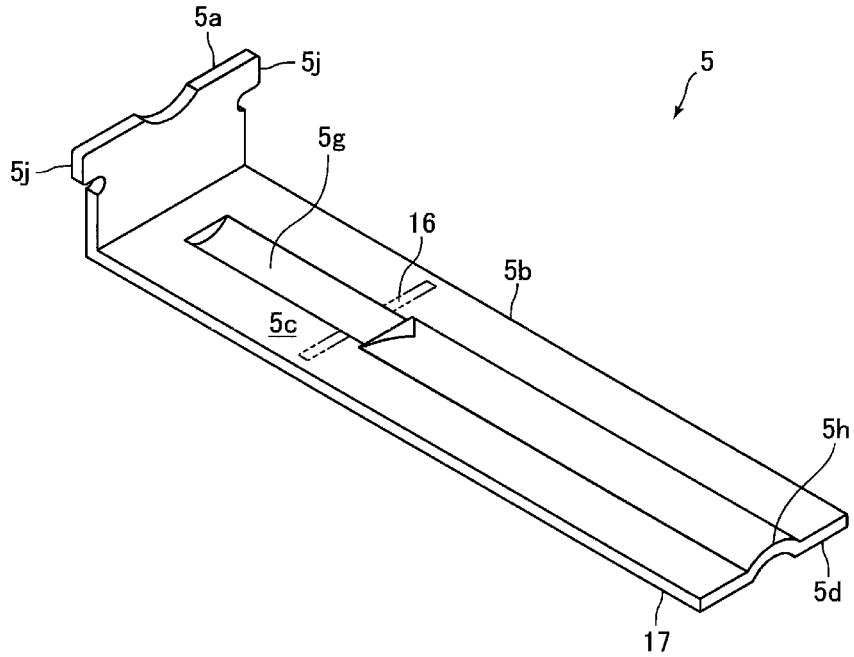
FIGS. 4(A) and 4(B) are perspective views showing a lever member in accordance with another embodiment of the present invention.

In the embodiment described above, in the lever member 5, the reinforcing flange 5*f* is formed as a first reinforcing part and the reinforcing flange 5*e* is formed as a second reinforcing part. However, the present invention is not limited to this embodiment. For example, as shown in FIG. 4(A), in the lever member 5, a reinforcing rib 5*g* as the first reinforcing part may be formed in the longitudinal direction of the lever member 5 and a reinforcing rib 5*h* as the second reinforcing part may be formed in the longitudinal direction of the lever member 5. In other words, the reinforcing rib 5*g* may be continuously formed on the upper face 5*d* side of the long side part 5*b* from the base end of the long side part 5*b* in the longitudinal direction of the long side part 5*b* to a slightly right side with respect to the plunger abutting part 16 so as to protrude to the upper side (lower side in FIG. 4(A)), and the reinforcing rib 5*h* may be continuously formed on the under face 5*c* side of the long side part 5*b* from a slightly right side with respect to the plunger abutting part 16 in the longitudinal direction of the long side part 5*b* to the tip end of the long side part 5*b* so as to protrude to the lower side (upper side in FIG. 4(A)).

In the embodiment shown in FIG. 4(A), the reinforcing ribs 5*g* and 5*h* are formed so that the right end of the reinforcing rib 5*g* and the left end of the reinforcing rib 5*h* are substantially coincided with each other in the longitudinal direction of the long side part 5*b*. Further, in the embodiment shown in FIG. 4(A), the reinforcing ribs 5*g* and 5*h* are formed so that a substantially center portion of the long side part 5*b* in the front and rear direction is bent in a substantially circular arc shape. In accordance with an embodiment of the present invention, the reinforcing ribs 5*g* and 5*h* may be formed so that a predetermined portion of the long side part 5*b* in the front and rear direction is bent in a substantially polygonal shape such as a substantially triangular shape or a substantially rectangular shape. Further, the reinforcing ribs 5*g* and 5*h* may be formed so that a beam in a substantially cylindrical shape or a beam in a substantially polygonal pillar shape is fixed to the under face 5*c* or the upper face 5*d* of the long side part 5*b*.

Figure 4B:
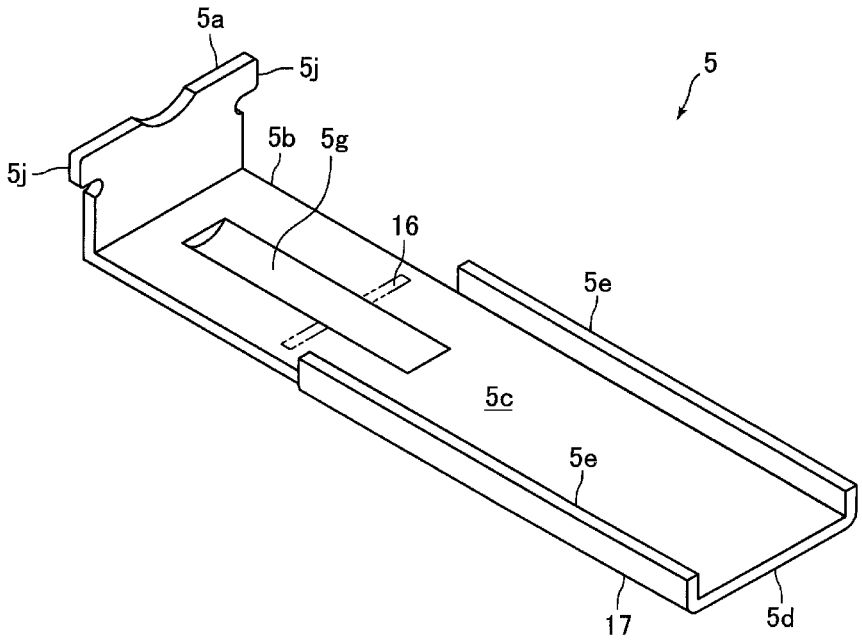
Figure 5:
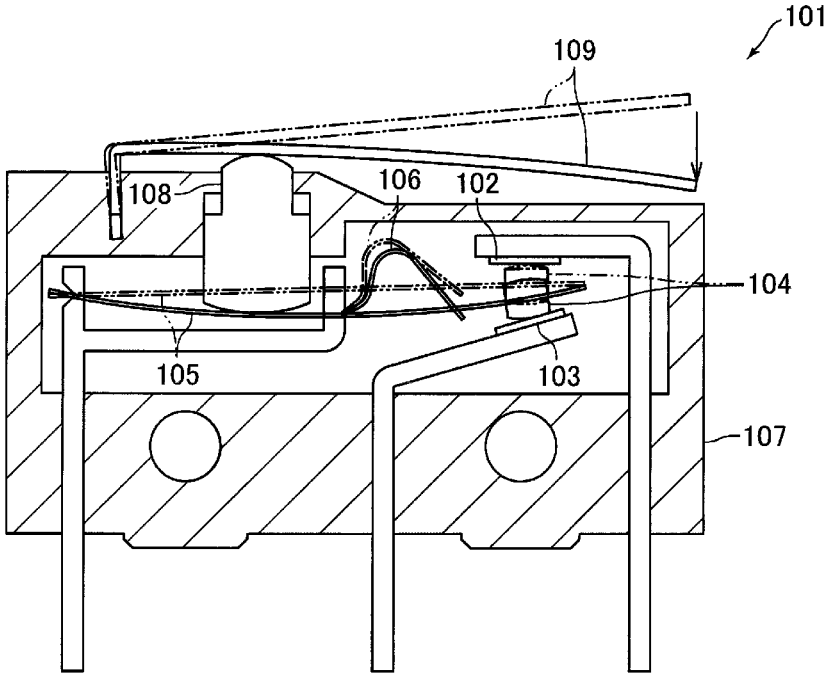
FIG. 5 is a cross-sectional view showing a conventional microswitch.
Figure 6:
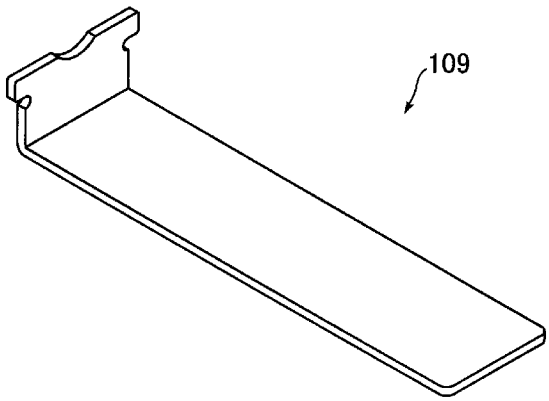
FIG. 6 is a perspective view showing a lever member shown in FIG. 5.

Alternatively, as shown in FIG. 4(B), the lever member 5 may be formed with a reinforcing rib 5*g* as the first reinforcing part and reinforcing flanges 5*e* as the second reinforcing part. In other words, the reinforcing rib 5*g* may be formed on the upper face 5*d* side of the long side part 5*b* from the base end of the long side part 5*b* in the longitudinal direction of the long side part 5*b* to a slightly right side with respect to the plunger abutting part 16 and the reinforcing flanges 5*e* may be formed on the under face 5*c* side of the long side part 5*b* from a slightly right side with respect to the plunger abutting part 16 in the longitudinal direction of the long side part 5*b* to the tip end of the long side part 5*b*.

In this case, as shown in FIG. 4(B), it is preferable that the reinforcing rib 5*g* and the reinforcing flanges 5*e* are formed so that the right end side portion of the reinforcing rib 5*g* and the left end side portions of the reinforcing flanges 5*e* are overlapped with each other in the longitudinal direction of the long side part 5*b*. According to this structure, the rigidity of the lever member 5 can be increased further effectively. In accordance with an embodiment of the present invention, the lever member 5 may be formed with the reinforcing flanges 5*f* as the first reinforcing part and the reinforcing rib 5*h* as the second reinforcing part.

In the embodiment described above, the reinforcing flanges 5*e* and 5*f* are formed so that the right end of the reinforcing flange 5*f* and the left end of the reinforcing flange 5*e* are substantially coincided with each other in the longitudinal direction of the long side part 5*b*. However, the present invention is not limited to this embodiment. For example, the reinforcing flanges 5*e* and 5*f* may be formed so that a space is formed between the right end of the reinforcing flange 5*f* and the left end of the reinforcing flange 5*e* in the longitudinal direction of the long side part 5*b*. Further, in the embodiment described above, the reinforcing flanges 5*e* and 5*f* are continuously formed in the longitudinal direction of the long side part 5*b* without a cut-out part in its intermediate portion. However, the reinforcing flange 5*e* and/or the reinforcing flange 5*f* may be intermittently formed in a separated manner in the longitudinal direction of the long side part 5*b*. Further, when the reinforcing flange 5*e* and/or the reinforcing flange 5*f* are intermittently formed in the longitudinal direction of the long side part 5*b*, the reinforcing ribs 5*g* and 5*h* may be formed in spaces formed between the intermittent reinforcing flanges 5*e* and/or the intermittent reinforcing flanges 5*f*.

In the embodiment described above, the reinforcing flange 5*f* is formed from the base end of the long side part 5*b* in the longitudinal direction of the long side part 5*b* to the slightly right side with respect to the plunger abutting part 16 and the reinforcing flange 5*e* is formed from the slightly right side with respect to the plunger abutting part 16 in the longitudinal direction of the long side part 5*b* to the tip end of the long side part 5*b*. However, the present invention is not limited to this embodiment. For example, the reinforcing flange 5*f* may be formed between the base end of the long side part 5*b* and the plunger abutting part 16 in the longitudinal direction of the long side part 5*b* and the reinforcing flange 5*e* may be formed between the plunger abutting part 16 and the tip end of the long side part 5*b* in the longitudinal direction of the long side part 5*b*. Further, the reinforcing flange 5*f* may be formed from the base end of the long side part 5*b* to a slightly left side with respect to the plunger abutting part 16 in the longitudinal direction of the long side part 5*b* and the reinforcing flange 5*e* may be formed from a slightly right side with respect to the plunger abutting part 16 to the tip end of the long side part 5*b* in the longitudinal direction of the long side part 5*b*.

In the embodiment described above, the reinforcing flange 5*f* is formed from the base end side of the lever member 5 toward the plunger abutting part 16 and the reinforcing flange 5*e* is formed from the tip end side of the lever member 5 toward the plunger abutting part 16. However, the present invention is not limited to this embodiment. For example, in a case that the reinforcing flange 5*f* is formed at a position avoiding the object abutting part 17 and the reinforcing flange 5*e* is formed at a position avoiding the plunger abutting part 16, the reinforcing flange 5*f* is not required to be formed from the base end side of the lever member 5 toward the plunger abutting part 16 and the reinforcing flange 5*e* is not required to be formed from the tip end side of the lever member 5 toward the plunger abutting part 16.

In the embodiment described above, the housing 3 is formed of liquid crystalline thermoplastic resin such as liquid crystal polymer. However, the present invention is not limited to this embodiment. For example, the housing 3 may be formed of crystalline thermoplastic resin. In this case, in order to enhance the heat resisting property of the housing 3, it is preferable to perform anneal treatment on the housing 3. Further, the housing 3 may be formed of thermosetting resin such as phenol resin.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. A microswitch comprising:

a housing into which a switch mechanism is incorporated;

a plunger which is movably held by the housing, the plunger configured to transmit power to the switch mechanism; and a lever member in a plate spring shape whose base end side is supported by the housing and which is turnable with the base end side as a supporting point;

wherein a tip end of the plunger is abutted with one face of the lever member in a turning direction of the lever member at an intermediate position in a longitudinal direction of the lever member, and an object to be detected is capable of abutting with an other face of the lever member in the turning direction of the lever member on a tip end side of the lever member; and wherein, when a portion of the lever member where the tip end of the plunger is abutted is a plunger abutting part and a portion of the lever member where the object to be detected is capable of abutting is an object abutting part, a first reinforcing part configured to reinforce strength of the lever member is formed at a position avoiding the object abutting part in the other face of the lever member, and a second reinforcing part configured to reinforce strength of the lever member is formed at a position avoiding the plunger abutting part in the one face of the lever member.

2. The microswitch according to claim 1, wherein the first reinforcing part is formed from the base end side of the lever member toward the plunger abutting part, and the second reinforcing part is formed from the tip end side of the lever member toward the plunger abutting part.

3. The microswitch according to claim 2, wherein the first reinforcing part and the second reinforcing part are continuously formed in the longitudinal direction of the lever member.

4. The microswitch according to claim 3, wherein a tip end side end of the first reinforcing part in the longitudinal direction of the lever member is disposed on the tip end side of the lever member with respect to the plunger abutting part, and a base end side end of the second reinforcing part in the longitudinal direction of the lever member is disposed on the tip end side of the lever member with respect to the plunger abutting part.

5. The microswitch according to claim 3, wherein a tip end side end of the first reinforcing part in the longitudinal direction of the lever member and a base end side end of the second reinforcing part in the longitudinal direction of the lever member are substantially coincided with each other in the longitudinal direction of the lever member.

6. The microswitch according to claim 3, wherein a tip end side end portion of the first reinforcing part in the longitudinal direction of the lever member and a base end side end portion of the second reinforcing part in the longitudinal direction of the lever member are overlapped with each other in the longitudinal direction of the lever member.

7. The microswitch according to claim 1, wherein at least one of the first reinforcing part and the second reinforcing part is a reinforcing flange which is formed by bending an end part of the lever member in a direction perpendicular to the longitudinal direction of the lever member or a reinforcing rib which is formed along the longitudinal direction of the lever member.

8. The microswitch according to claim 1, wherein the housing is formed of thermoplastic resin.

9. The microswitch according to claim 8, wherein the housing is formed of liquid crystalline thermoplastic resin.

10. The microswitch according to claim 4, wherein a tip end side end portion of the first reinforcing part in the longitudinal direction of the lever member and a base end side end portion of the second reinforcing part in the longitudinal direction of the lever member are overlapped with each other in the longitudinal direction of the lever member.

11. The microswitch according to claim 2, wherein at least one of the first reinforcing part and the second reinforcing part is a reinforcing flange which is formed by bending an end part of the lever member in a direction perpendicular to the longitudinal direction of the lever member or a reinforcing rib which is formed along the longitudinal direction of the lever member.

* * * * *